US006202987B1

(12) United States Patent
Forbis

(10) Patent No.: US 6,202,987 B1
(45) **Date of Patent: *Mar. 20, 2001**

(54) FENCE SYSTEM

(75) Inventor: John T. Forbis, York, NE (US)

(73) Assignee: Kroy Building Products, Inc., York, NE (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/435,418

(22) Filed: Nov. 8, 1999

Related U.S. Application Data

(60) Continuation of application No. 09/238,754, filed on Jan. 28, 1999, now Pat. No. 6,041,486, which is a division of application No. 08/808,981, filed on Feb. 19, 1997, now Pat. No. 5,988,599.

(51) Int. Cl.[7] ..... E04H 17/16
(52) U.S. Cl. ..... 256/24; 256/19
(58) Field of Search ..... 256/24, 56, 66, 256/65, 19, 13.1, 59, 73, 34, 25, 26, 22; 403/325

(56) References Cited

U.S. PATENT DOCUMENTS

| | | | | |
|---|---|---|---|---|
| 3,395,489 | | 8/1968 | Banse . | |
| 3,522,933 | | 8/1970 | Braun . | |
| 3,648,981 | | 3/1972 | Allen . | |
| 3,712,590 | | 1/1973 | Tochner et al. | 256/34 |
| 3,822,053 | * | 7/1974 | Daily | 256/22 |
| 3,924,834 | | 12/1975 | Young . | |
| 4,007,919 | | 2/1977 | Totten . | |
| 4,027,855 | | 6/1977 | Lauzier | 256/65 X |
| 4,188,019 | | 2/1980 | Meredith | 2256/73 X |
| 4,202,532 | | 5/1980 | Mills . | |
| 4,346,872 | | 8/1982 | Toruya . | |
| 4,585,214 | | 4/1986 | Cope . | |
| 4,809,955 | | 3/1989 | Veilleux . | |
| 5,011,325 | | 4/1991 | Antonioli | 256/13.1 |
| 5,192,056 | | 3/1993 | Espinueva . | |
| 5,200,240 | | 4/1993 | Baker | 256/73 X |
| 5,215,290 | | 6/1993 | Khalessi . | |
| 5,480,126 | * | 1/1996 | Teasdale | 256/19 |
| 5,702,090 | | 12/1997 | Edgman . | |
| 5,988,599 | * | 11/1999 | Forbis | 256/24 |

OTHER PUBLICATIONS

Nebraska Plastics, Inc., Guia De Planeamiento E Instalacion De Cercas Residenciales, Country Estates Fence. Cover Page and pp. 16 and 25, Oct. 1995.

Nebraska Plastics, Inc., Residential Fence Planning & Installation Guide, Country Estates Fence, Cover Page and p. 21, Apr. 1994.

* cited by examiner

*Primary Examiner*—Harry C. Kim
(74) *Attorney, Agent, or Firm*—Clayton, Howarth, & Cannon, P.C.

(57) ABSTRACT

A modular fence system. The system includes fence planks designed for insertion into open channels of upper and lower fence rails. The fence rails are supported in a horizontal orientation between intermittent fence posts, with the fence planks extending vertically between the rails. The planks include resilient protrusions, called plank-projections, at their upper ends. The plank-projections are designed to engage with channel-projections formed in the open channels of the upper fence rail and lower fence rail, to inhibit inadvertent removal of the planks from the upper rail. Alternatively, the plank-projections may be eliminated in favor of having the channel-projections simply grip the planks frictionally, or, vice versa, the channel-projections could be eliminated in favor of having the plank-projections press frictionally against the walls of the open channels in the upper rail or lower rail or both. Accordingly, the engagement between the upper rail and the planks takes some weight off the lower rail such that fewer support posts are needed, and that engagement can be provided with just the channel-projections, or just the plank-projections, or both.

28 Claims, 3 Drawing Sheets

FENCE SYSTEM

CROSS-REFERENCE TO RELATED APPLICATIONS

This application is a continuing application of co-pending U.S. patent application Ser. No. 09/238,754, filed Jan. 28, 1999, now U.S. Pat. No. 6,041,486 entitled "Fence System," which is incorporated herein by reference in its entirety and which is a divisional of U.S. patent application Ser. No. 08/808,981, filed Feb. 19, 1997, now U.S. Pat. No. 5,988, 599 entitled "Fence System," also incorporated herein by reference in its entirety.

STATEMENT REGARDING FEDERALLY SPONSORED RESEARCH OR DEVELOPMENT

Not Applicable.

BACKGROUND OF THE INVENTION

1. The Field of the Invention

The present invention relates generally to modular fence systems. More particularly, it concerns a modular fence plank that is lockably insertable into an open channel of a fence rail.

2. The Background Art

Modular fence systems are becoming increasingly popular with home owners and businesses. Vinyl polymeric fence components have been designed for use in assembling an attractive, durable fence that is much more resistant to weathering than traditional fencing.

The prior art modular fence systems are characterized by a number of disadvantages. Some systems require the laborious and time consuming practice of fastening the fence components with nuts and bolts or other fastening devices. Some of the more decorative-oriented fence systems utilize a lower fence rail to support substantially the entire weight of the planks of the fence, a design that requires a higher frequency of intermittent support posts to inhibit sagging in the lower fence rail.

The prior art is thus characterized by several disadvantages that are addressed by the present invention. The present invention minimizes, and in some aspects eliminates, the above-mentioned failures, and other problems, by utilizing the methods and structural features described herein.

OBJECTS AND SUMMARY OF THE INVENTION

It is therefore an object of the present invention to provide a fence system that is simple in design and easy to assemble.

It is another object of the invention, in accordance with one aspect thereof, to provide such a fence system that supports at least some of the weight of the planks by holding the upper ends of the planks in combination with resting them upon a lower fence rail, thereby requiring fewer intermittent support posts.

It is a further object of the invention to provide such a fence system having fence planks that are lockably insertable into supporting fence rails.

The above objects and others not specifically recited are realized in a specific illustrative embodiment of a modular fence system. The system includes fence planks designed for insertion into open channels of upper and lower fence rails. The fence rails are supported in a horizontal orientation between intermittent fence posts, with the fence planks extending vertically between the rails. The planks include resilient protrusions, called plank-projections, at their upper ends. The plank-projections are designed to engage with channel-projections formed in the open channels of the upper fence rail and lower fence rail, to inhibit inadvertent removal of the planks from the upper rail. Alternatively, the plank-projections may be eliminated in favor of having the channel-projections simply grip the planks frictionally, or, vice versa, the channel-projections could be eliminated in favor of having the plank-projections press frictionally against the walls of the open channels in the upper rail or lower rail or both. Accordingly, the engagement between the upper rail and the planks takes some weight off the lower rail such that fewer support posts are needed, and that engagement can be provided with just the channel-projections, or just the plank-projections, or both.

Additional objects and advantages of the invention will be set forth in the description which follows, and in part will be apparent from the description, or may be learned by the practice of the invention without undue experimentation. The objects and advantages of the invention may be realized and obtained by means of the instruments and combinations particularly pointed out in the appended claims.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION OF PRESENTLY PREFERRED EMBODIMENTS

Figure 1:
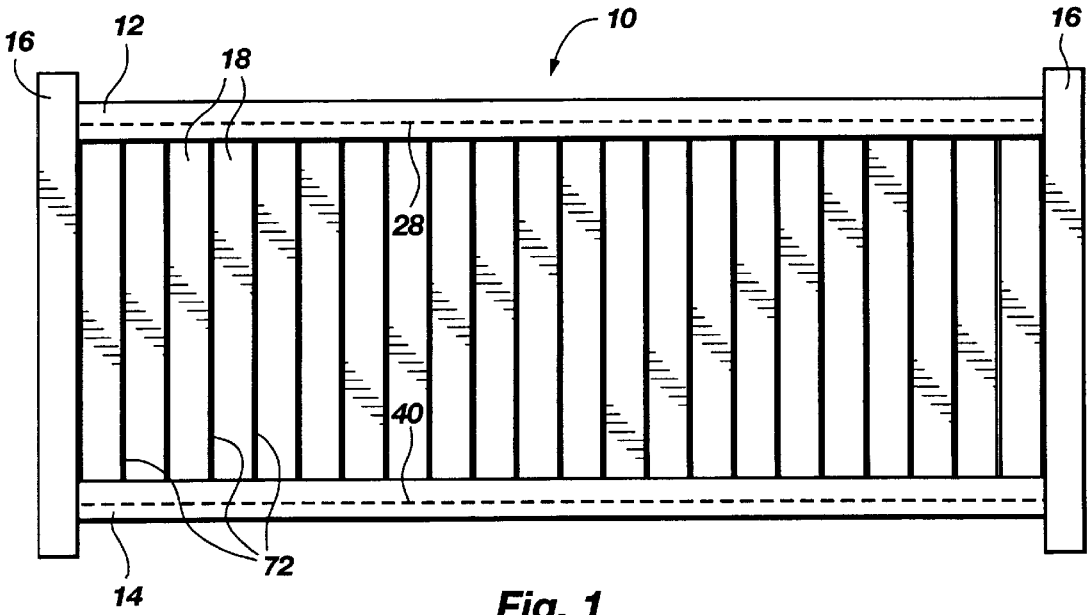
FIG. 1 is a frontal view of a fence system, made in accordance with the principles of the present invention.

For the purposes of promoting an understanding of the principles in accordance with the invention, reference will now be made to the embodiments illustrated in the drawings and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would normally occur to one skilled in the relevant art and having possession of this disclosure, are to be considered within the scope of the invention claimed.

Applicant has discovered that a modular fence system can be designed that is easier to assemble, and requires a lower frequency of intermittent support posts. Applicant's inventive combinations as disclosed herein provide a fence system that requires less time to install, yet is structurally sound and aesthetically pleasing.

Figure 2:
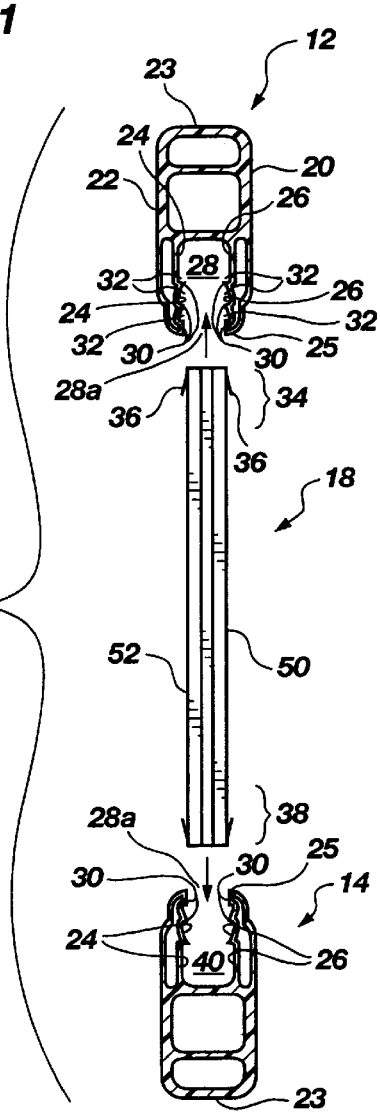
FIG. 2 is an exploded end view of a fence plank and upper and lower fence rails of the fence system of FIG. 1.
Figure 3:
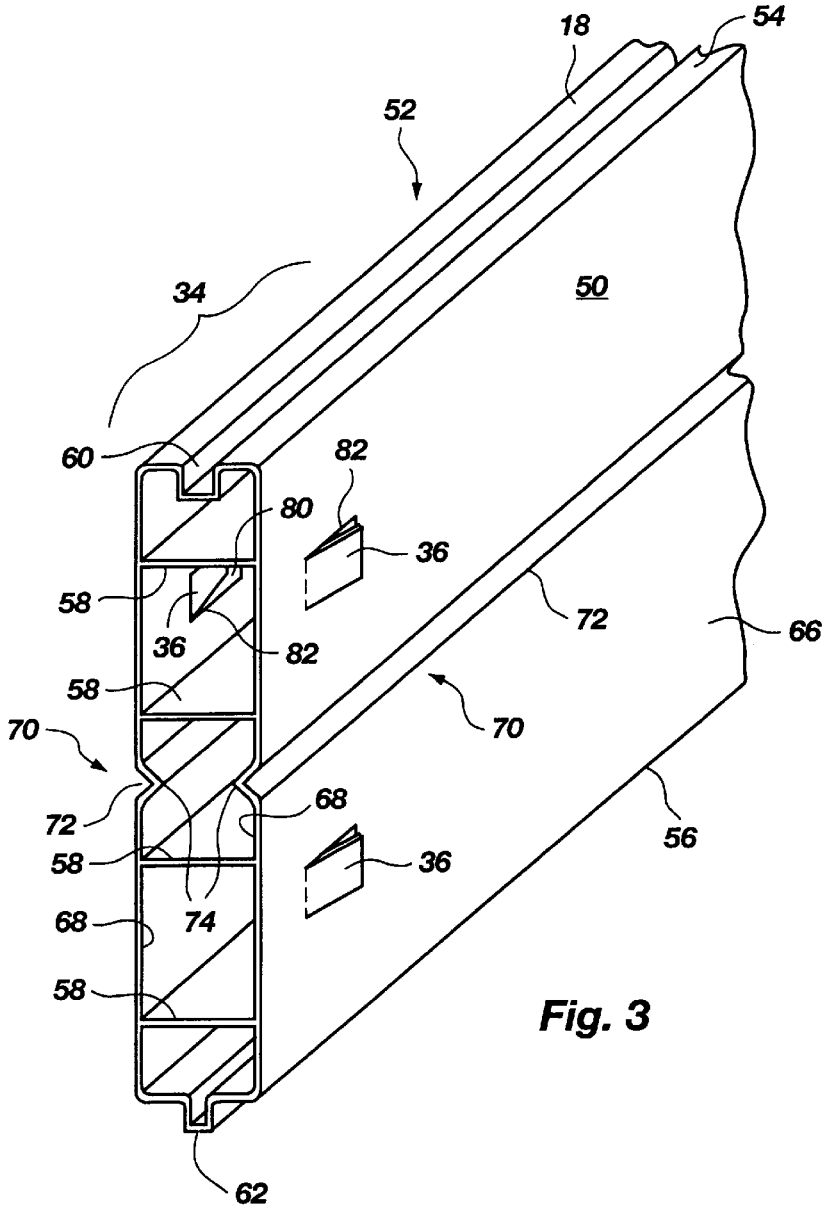
FIG. 3 is a perspective, break away view of the fence plank of FIG. 2.

Referring now to FIGS. 1–3, there is shown a fence system designated generally at 10 in FIG. 1. The fence system 10 includes upper and lower fence rails 12 and 14 coupled to intermittent fence posts 16. A plurality of fence planks 18 are supported between the upper and lower fence rails 12 and 14. The upper fence rail 12 is thus configured to be supported in a laterally extending, elevated orientation.

The upper fence rail 12 comprises a first side 20, an opposing second side 22, a top side 23 and a bottom side 25. A first interior, channel sidewall surface 24 and an opposing second interior, channel sidewall surface 26 define an open channel 28 therebetween having an elongate channel entrance 28*a* extending along a majority length of the bottom side 25 of the rail 12. The upper fence rail 12 includes ledges or channel-projections 30 protruding outwardly from the first and second interior channel sidewall surfaces 24 and 26, respectively, for supporting the fence planks 18 thereon. Each channel-projection 30 defines a passage 32.

Each plank 18 preferably includes a first exterior end section 34 configured for inserting into the open channel 28 of the upper fence rail 12. Protrusions or plank-projections 36 are preferably formed as part of the planks 18 and extend outwardly from exterior surfaces of the first exterior end section 34 of the plank 18 for engaging with the channel-projections 30, preferably by protruding into the passages 32 defined by the channel-projections 30 on the first and second interior channel sidewall surfaces 24 and 26, respectively. The plank-projections 36 thereby engage against the channel-projections 30, which are considered to be part of the channel-sidewalls to inhibit inadvertent removal of the planks 18 from the upper fence rail 12. As shown in the drawings, the plank-projections 36 preferably extend outwardly from a front wall 50 or a rear wall 52 of the plank 18. As such, the plank-projections 36 are part of the plank 18, but are not considered to be part of the front wall 50 or the rear wall 52, although said projections extend therefrom.

In this manner, the upper fence rail 12 provides structural support for the fence planks 18. The planks 18 are thus supported by both the upper and lower fence rails 12 and 14, as opposed to prior art fence systems wherein only the lower fence rail supports the planks. The fence posts 16 are spaced close enough together to inhibit substantially sagging of the lower fence rail 14. Since the fence system 10 distributes the weight of the planks 18 between both the upper rail 12 and the lower rail 14, the frequency of the fence posts 16 is less and thus fewer fence posts 16 are required, resulting in a saving of material cost and labor of installation.

Each fence plank 18 further includes a second end section 38 opposite the first end section 34. The lower fence rail 14 also has an open channel 40 formed therein for receiving the second end sections 38 of the planks 18 thereinto. The lower fence rail 14 is preferably identical to the upper fence rail 12 in design, and includes the ledges and passages, as shown in FIG. 2. Alternatively, the lower fence rail 14 may comprise a rail 14*a* as in FIG. 4, defining a smooth open channel 40*a* and an absence of the internal ledges and passages. The upper fence rail 12 may of course also comprise a rail in the manner shown in FIG. 4, defining a smooth open channel 40*a* and an absence of the internal ledges and passages.

The ledges or channel-projections 30 preferably comprise first and second arrays of elongate ledges extending lengthwise along the first and second interior sidewalls, respectively, to enable selective engagement of the plank-projections 36 of the fence planks 18 against the ledges 30 of the first and second arrays, respectively. Preferably, each array of elongate ledges 30 comprises at least two ledges disposed in substantial parallel orientation as shown. The ledges 30 of the first and second arrays are equal in number to define pairs of ledges, each pair comprising a ledge from the first array and a ledge from the second array, such that the ledges in each pair are substantially parallel and reside common to a single plane extending substantially perpendicular to the sides 20 and 22 of the rail 12. The upper fence rail 12 and the sidewalls 20, 22 and ledges 30 thereof preferably comprise a one-piece, unitary member made of a resilient material having elastic memory, such as vinyl. The plank-projections 36 of the planks 18 also preferably comprise a resilient material having elastic memory. The feature of resilient material having elastic memory operates to permit a locking engagement of the plank-projections 36 into the passages 32. The plank-projections 36 can be "snapped" into place into the passages 32 and against the tops of the ledges or channel-projections 30.

Referring more particularly to FIG. 3, the fence planks 18 are hollow, each plank having a front wall 50, an opposing rear wall 52, and a left sidewall 54 and a right sidewall 56 coupled between the front and rear walls 50 and 52 at opposing sides thereof, respectively. A plurality of internal bracing walls 58 are disposed between the rear wall 52 and the front wall 50. The left sidewalls 54 have an elongate channel 60 formed therein, and the right sidewalls 56 have an elongate projection 62 formed thereon configured and dimensioned to be inserted into the channel 60 of the left sidewalls 54 of adjacent planks 18 for additional support.

The front and rear walls 50 and 52 of each plank 18 include an exterior surface 66 and an interior surface 68, and preferably an elongate groove 70 is formed in each of said front and rear walls extending lengthwise along the plank 18. The elongate grooves 70 in the front and rear walls comprise a crease in said front and rear walls, defined by a furrow 72 formed in the exterior surface 66, and an opposing ridge 74 formed in the interior surface 68. The grooves 70 are optional, and the front and rear walls 50 and 52 may alternatively comprise substantially planer walls characterized by an absence of grooves or other non-planer structure.

The grooves 70 define a kind of "V" shape as shown in FIG. 3. This structural variation provides increased strength to the front and rear walls 50 and 52, to inhibit buckling and bending. The "V" grooves 70 further provide an enhanced aesthetic appeal to the planks 18. The planks 18 preferably comprise a cross section of one inch by 8 inches, and the "V" grooves 70 produce the appearance four inch planks even though the planks are eight inches wide in reality.

Regarding the plank-projections 36, the front and rear walls 66 and 68 of the planks 18 each include an opening 80 formed in the first end section 34 of the plank 18, such that a circumferential edge 82 defines said opening 80. The plank-projections 36 extend outwardly from a portion of said circumferential edges 82. Most preferably, the plank-projections 36 each comprise a severed portion of the walls 50 and 52 of the planks 18, whereby the plank-projections 36 are simply cut apart from the front and rear walls 50 and 52 to form the openings 80, and the plank-projections 36 are crimped into an outwardly extending orientation. The plank-projections 36 might therefore also be referred to as tab pieces.

It is to be understood that one aspect of the present invention contemplates the plank 18 as in FIG. 3 without the plank-projections 36 formed thereon. The upper and lower fence rails could simply function as retaining channels, such that no part of the plank extends into the passages 32 in a locking relationship against the tops of the ledges 30. Accordingly, the planks 18 without plank-projections 36 would in such a case be configured and dimensioned to be wide enough to be engaged by the channel-projections 30 when the first end section 34 of the planks 18 are inserted into the open channel 28 of the rail 12, for increased support of the fence planks 18.

Figure 5:
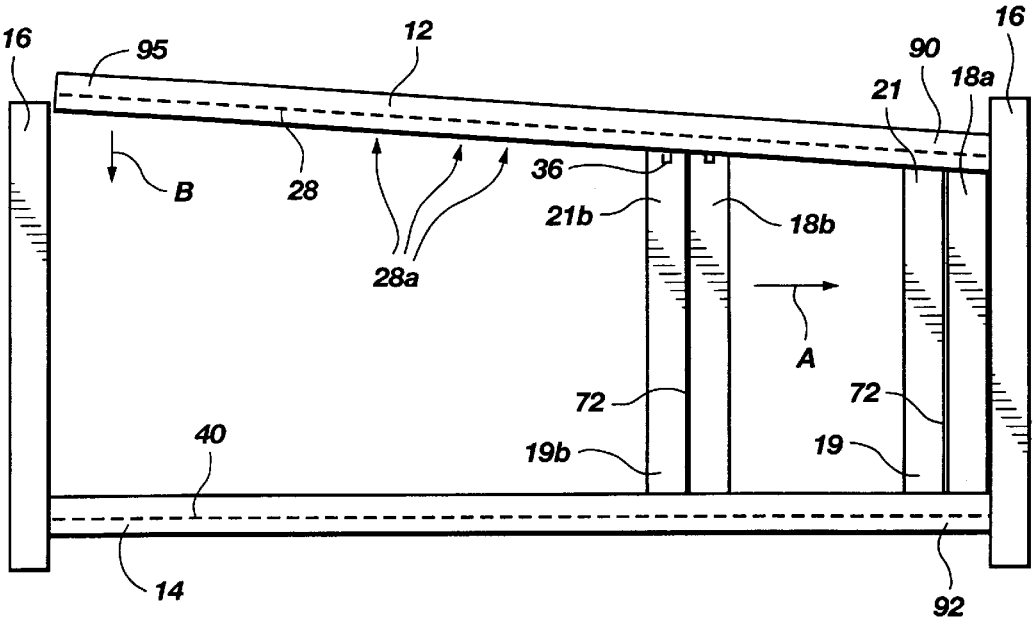
FIG. 5 is a frontal view of a partially assembled fence system being assembled in accordance with the principles of the present invention.

For example, and in further reference to the alternative design in which the planks 18 would be constructed without the plank-projections 36 formed thereon, it is shown most clearly by FIGS. 2 and 5, that the upper fence rail 12 can be described as including an elongate open channel 28 formed in the bottom side 25 of the rail 12 such that the elongate open channel 28 includes an elongate channel-entrance 28*a* that extends lengthwise along a majority length of the bottom side 25 of the rail 12, the rail 12 further including spaced apart channel-sidewalls extending inwardly from the elongate channel-entrance 28*a* in the bottom side 25 of the rail 12 in a direction toward the top side 23 of the rail 12 to thereby define the elongate open channel 28 therebetween.

The fence planks 18 may be described as a plurality of fence planks having free end sections 34 and 38 that are configured and dimensioned to extend through the elongate entrance 28*a* of the open channel 28 and reside slidably within said open channel 28 to thereby enable the fence planks 18 to be slidable toward and away from each other along the open channel 28 when their free ends 34 and 38 are positioned through the entrance 28*a* and into the open channel 28.

The channel-projections 30 may be described as at least one channel-projection formed as part of at least one of the channel-sidewalls of the rail 12, said channel-projection extending outwardly from a surface of the channel-sidewall into engagement with the fence planks 18 when said fence planks 18 are placed into the open channel 28, for increased support of the fence planks 18.

Figure 4:
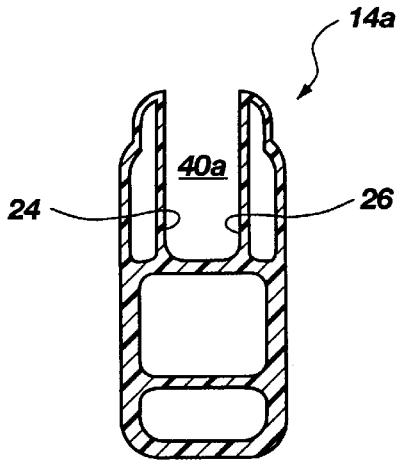
FIG. 4 is an end view of an alternative embodiment of the lower fence rail of FIG. 2.

Referring now to FIGS. 2 and 4, and in further reference to the alternative design in which the rails 12 and 14 could be constructed without the channel-projections 30 formed thereon as shown by alternative rail 14*a* in FIG. 4, it is shown in those figures that the planks 18 can be described as including at least one plank-projection 36 formed as part of each fence plank 18, said plank-projection 36 extending outwardly from a surface of the fence plank 18 into engagement with one of the channel-sidewalls when said fence planks 18 are placed into the channel 28, for increased support of the fence planks 18.

In other words and in accordance with the drawings and the descriptions above, a supportive engagement between the rails and the planks can be accomplished by engagement of plank-projections 36 against the channel-sidewalls in the absence of any channel-projections 30, or conversely by engagement of channel-projections 30 in a grip against the opposing exterior surfaces of a free end of the planks 18 in the absence of any plank-projections 36. Either of these alternatives can be designed in connection with either the upper rail 12, or the lower rail 14, or both.

The fence system 10 can be assembled in any suitable manner. Referring now to FIG. 5, a preferred method of assembling a fence comprises the steps of:

(a) coupling a first end 90 of an upper fence rail 12 and a first end 92 of a lower fence rail 14 to a fence post 16, and maintaining an opposing second end 95 of the upper fence rail 12 in an elevated orientation with relative to the first end 90 of said upper fence rail 12;

(b) placing a lower end 19 of a first fence plank 18*a* into an open channel 40 of the lower fence rail 14, and an opposing upper end 21 of said first fence plank 18*a* into an open channel 28 of the upper fence rail 12;

(c) placing a lower end 19*b* of a following fence plank 18*b* into the open channel 40 of the lower fence rail 14 and sliding said following fence plank 18*b* toward the first fence plank 18*a* (as illustrated by arrow A);

(d) gradually lowering the second end 95 of the upper fence rail 12 (as illustrated by arrow B) such that an upper end 21*b* of the following fence plank 18*b* becomes received into the open channel 28 of the upper fence rail 12;

(e) repeating steps (c) and (d) as many times as desired to thereby situate an array of fence planks 18 into position between the upper and lower fence rails 12 and 14.

The method set forth immediately above may be further augmented, wherein step (b) further comprises placing a projection 36 of the first fence plank 18*a* into an internal passage 32 (see FIG. 2) 28 of the upper fence rail 12 and into engagement with a ledge 30 defining the passage, and wherein step (d) further comprises placing a plank-projection 36 of the following fence plank 18*b* into an internal passage 32 of the upper fence rail 12 and into engagement with a ledge 30 defining said internal passage.

Figure 6:
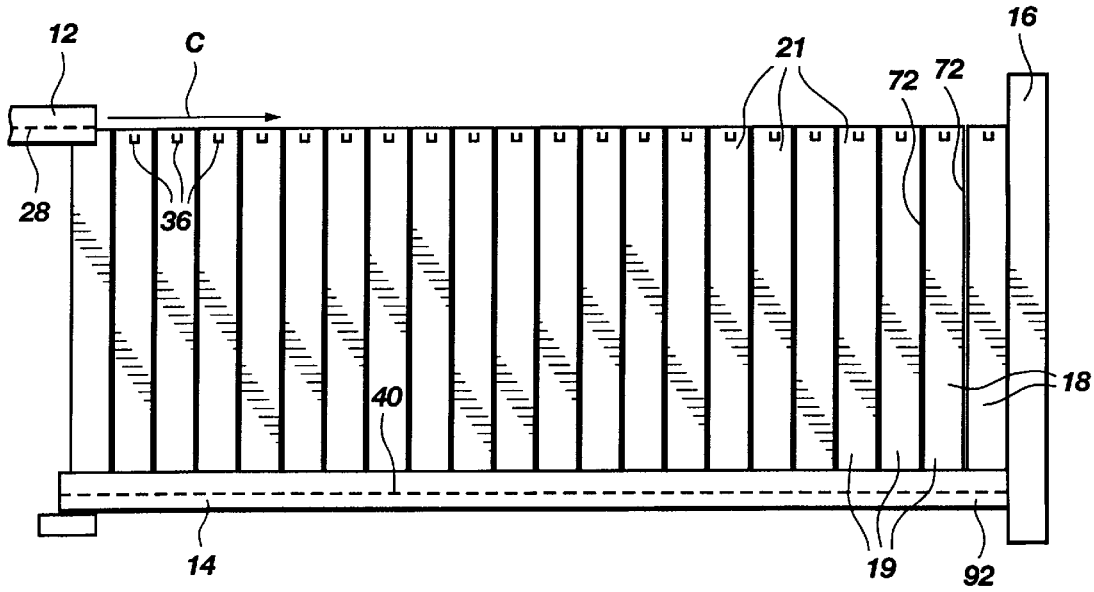
FIG. 6 is a frontal view of a partially assembled fence system being assembled in accordance with an alternative method of assembly.

Referring now to FIG. 6, a further method of assembling a fence comprises the steps of:

(a) coupling a first end 92 of a lower fence rail 14 to a support post 16;

(b) placing lower ends 19 of a plurality of fence planks 18 into an open channel 40 of the lower fence rail 14; and (c) sliding an upper fence rail 12 onto upper ends 21 of the plurality of fence planks 18 (illustrated by arrow C) such that said upper ends 21 of the planks 18 reside in an open channel 28 of the upper fence rail 12 with plank-projection 36 on said upper ends 21 extending into an internal passage 32 (shown in FIG. 2) of the upper fence rail 12 and into engagement with a ledge 30 (shown in FIG. 2) defining said internal passage.

The method set forth immediately above may be further augmented, wherein step (c) further comprises sliding the upper fence rail 12 sequentially along the upper ends 21 of the plurality of fence planks 18.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. A fence system comprising:

a rail configured to be supported in a laterally extending orientation for holding a plurality of elongate fence planks in an upwardly-extending position, said rail having an elongate top side and an elongate bottom side, said rail further including an elongate open channel formed in the bottom side of the rail such that said elongate open channel includes an elongate channel-entrance that extends lengthwise along a majority length of the bottom side of the rail, the rail further including spaced apart channel-sidewalls extending inwardly from the elongate channel-entrance in the bottom side of the rail in a direction toward the top side of the rail to thereby define the elongate open channel therebetween;

said plurality of fence planks having free ends configured and dimensioned to extend through the elongate channel-entrance of the open channel and reside slidably within said open channel to thereby enable the fence planks to be slidable toward and away from each other along the open channel when their free ends are positioned through the channel-entrance and into the open channel, and wherein each fence plank further comprises a front wall and a rear wall; and at least one channel-projection formed as part of at least one of the channel-sidewalls of the rail, said channel-projection extending outwardly from a surface of the channel-sidewall into engagement with the fence planks when said fence planks are placed into the open channel, for increased support of the fence planks;

wherein the at least one channel-projection comprises at least one elongate ledge extending from one of the channel-sidewall surfaces, said ledge extending lengthwise along a majority length of said channel-sidewall such that the engagement of said ledge with the fence planks operates to prevent the front walls or rear walls of the fence planks disposed in engagement with said elongate ledge from contacting the surface of said channel-sidewall when said fence planks are placed through the elongate channel-entrance and into the open channel, such that the fence planks are slidable toward and away from each other along the open channel in engagement with said elongate ledge.

2. The fence system of claim 1, wherein the fence planks are hollow, each plank having a front wall and an opposing rear wall., wherein the front and rear walls each include an elongate groove formed therein extending lengthwise along the plank.

3. The fence system of claim 1, wherein the at least one channel-projection comprises at least one elongate ledge formed on one of the channel-sidewalls, and at least one elongate ledge formed on the other of the channel-sidewalls, said ledges each extending lengthwise along a majority length of the channel-sidewall on which they are formed.

4. The fence system of claim 1, wherein the at least one channel-projection comprises at least two spaced-apart elongate ledges formed on one of the channel-sidewalls, said ledges extending lengthwise along a majority length of said channel-sidewall.

5. The fence system of claim 1, wherein the at least one channel-projection comprises at least two spaced-apart elongate ledges formed on one of the channel-sidewalls, and at least two spaced-apart elongate ledges formed on the other of the channel-sidewalls, said ledges each extending lengthwise along a majority length of the channel-sidewall on which they are formed.

6. The fence system of claim 1, said fence system being characterized by an absence of blocking structure residing between the fence planks along the open channel when the free ends of said fence planks are positioned through the channel-entrance and into the open channel, such that said fence planks remain slidable toward and away from each other along the open channel if desired.

7. The fence system of claim 1, wherein the at least one channel-projection comprises at least one elongate ledge formed on one of the channel-sidewalls and extending lengthwise continuously along a majority length of said channel-sidewall, such that the fence planks are slidable toward and away from each other along the open channel in frictional engagement against said elongate ledge.

8. The fence system of claim 7, wherein the rail and the sides, channel-sidewalls and at least one elongate ledge thereof collectively comprise a one-piece, unitary member made of a resilient material having elastic memory.

9. The fence system of claim 1, wherein the fence planks each include a front wall and an opposing rear wall, and a plurality of internal bracing walls disposed between the front and rear walls in a transverse orientation with respect to said front and rear walls.

10. The fence system of claim 1, wherein the fence planks are hollow, each plank having a front wall, an opposing rear wall, and a left sidewall and a right sidewall coupled between the front and rear walls at opposing sides thereof, respectively;

wherein the left sidewalls have an elongate channel formed therein, and the right sidewalls have an elongate projection formed thereon configured and dimensioned to be inserted into the channel of the left sidewalls of adjacent planks for additional support.

11. The fence system of claim 10, wherein the front and rear walls each include an elongate groove formed therein extending lengthwise along the plank.

12. The fence system of claim 1, wherein the open channel extends continuously along the majority length of the rail, without interruption.

13. The fence system of claim 1, further comprising at least one plank-projection formed as part of each of the fence planks, said plank-projection extending outwardlv from either the front wall or the rear wall of the fence plank into engagement with the ledge when said fence planks are placed into the channel, for increased support of the fence planks.

14. A fence system comprising:

a rail configured to be supported in a laterally extending orientation for holding a plurality of elongate fence planks in an upwardly-extending position, said rail having an elongate top side and an elongate bottom side, said rail further including an elongate open channel formed in the bottom side of the rail such that said elongate open channel includes an elongate channel-entrance that extends lengthwise along a majority length of the bottom side of the rail, the rail further including spaced apart channel-sidewalls extending inwardly from the elongate channel-entrance in the bottom side of the rail in a direction toward the top side of the rail to thereby define the elongate open channel therebetween;

said plurality of fence planks having free ends configured and dimensioned to extend through the elongate channel-entrance of the open channel and reside slidably within the open channel to thereby enable the fence planks to be slidable toward and away from each other along the open channel when their free ends are positioned through the channel-entrance and into the open channel, and wherein each fence plank further comprises a front wall and a rear wall; and at least one plank-projection formed as part of each fence plank, said plank-projection extending outwardly from a surface of the fence plank into engagement with one of the channel-sidewalls when said fence planks are placed into the channel, such that the engagement of said plank-projection with the channel-sidewall operates to prevent any portion of the front walls or rear walls of the fence planks from contacting the surface of said channel-sidewall when said fence planks are placed through the elongate channel-entrance and into the open channel, for increased support of the fence planks.

15. The fence system of claim 14, wherein the at least one plank-projection comprises a tab piece extending outwardly from an exterior surface of the fence plank at an acute angle relative to said exterior surface, said tab piece having an elastic memory connection to said exterior surface such that depression of said tab piece causes said tab piece to exert a reactive force against said depression.

16. The fence system of claim 14, wherein the fence planks are hollow, each plank having a front wall, an opposing rear wall, and a left sidewall and a right sidewall coupled between the front and rear walls at opposing sides thereof, respectively;

wherein the left sidewalls have an elongate channel formed therein, and the right sidewalls have an elongate projection formed thereon configured and dimensioned to be inserted into the channel of the left sidewalls of adjacent planks for additional support.

17. The fence system of claim 14, wherein the planks are hollow and are comprised of sidewalls, said sidewalls having an opening formed in a free end section of the planks such that a circumferential edge defines said opening, and wherein the at least one plank-projection extends outwardly from a portion of said circumferential edge.

18. The fence system of claim 17, wherein the at least one plank-projection comprises a severed portion of the walls of the plank.

19. A fence system comprising:

a rail configured to be supported in a laterally extending orientation for holding a plurality of elongate fence planks in an upwardly-extending position, said rail having an elongate top side and an elongate bottom side, said rail further including an elongate open channel formed in the bottom side of the rail such that said elongate open channel includes an elongate channel-entrance that extends lengthwise along a majority length of the bottom side of the rail, the rail further including spaced apart channel-sidewalls extending inwardly from the elongate channel-entrance in the bottom side of the rail in a direction toward the top side of the rail to thereby define the elongate open channel therebetween;

said plurality of fence planks having free ends configured and dimensioned to extend through the elongate channel-entrance of the open channel and reside slidably within said open channel to thereby enable the fence planks to be slidable toward and away from each other along the open channel when their free ends are positioned through the channel-entrance and into the open channel;

at least one channel-projection formed as part of at least one of the channel-sidewalls of the rail, said channel-projection extending outwardly from a surface of the channel-sidewall into engagement with some portion of the fence planks when said fence planks are placed into the open channel, for increased support of the fence planks; and at least one plank-projection formed as a part of each fence plank, said plank-projection extending outwardly from a surface of the fence plank into engagement with the at least one channel-projection when said fence planks are placed into the channel, for increased support of the fence planks;

wherein the at least one channel-projection is configured and dimensioned such that its engagement with the fence planks operates to prevent the front walls and the rear walls of the fence planks disposed in engagement with said elongate channel-projection from contacting the surface of the channel-sidewall when said fence planks are placed into the open channel;

wherein the at least one channel-projection comprises at least one elongate ledge formed on one of the channel-sidewalls, and at least one elongate ledge formed on the other of the channel-sidewalls, said ledges each extending lengthwise along a majority length of the channel-sidewall on which they are formed, such that the fence planks are slidable toward and away from each other along the open channel in frictional engagement against said elongate ledges;

the fence system being characterized by an absence of blocking structure residing between the fence planks along the open channel when the free ends of said fence planks are positioned through the channel-entrance and into the open channel, such that said fence planks remain slidable toward and away from each other along the open channel if desired;

wherein the rail and the sides, channel-sidewalls and elongate ledges thereof collectively comprise a one-piece, unitary member made of a resilient material having elastic memory.

20. The fence system of claim 19:

wherein the at least one channel-projection comprises at least two spaced-apart elongate ledges formed on one of the channel-sidewalls, and at least two spaced-apart elongate ledges formed on the other of the channel-sidewalls, said ledges each extending lengthwise along the majority length of the channel-sidewall on which they are formed;

wherein the at least one plank-projection comprises a tab piece extending outwardly from an exterior surface of the fence plank at an acute angle relative to said exterior surface, said tab piece having an elastic memory connection to said exterior surface such that depression of said tab piece causes said tab piece to exert a reactive force against said depression;

wherein the planks are hollow and are comprised of sidewalls, said sidewalls having an opening formed in a free end section of the planks such that a circumferential edge defines said opening, and wherein the tab piece extends outwardly from a portion of said circumferential edge;

wherein the tab piece comprises a severed portion of the walls of the plank;

wherein the fence planks are hollow, each plank having a front wall and an opposing rear wall, wherein the front and rear walls each include an elongate groove formed therein extending lengthwise along the plank;

wherein the fence planks each include a front wall and an opposing rear wall, and a plurality of internal bracing walls disposed between the front and rear walls in a transverse orientation with respect to said front and rear walls.

21. The fence system of claim 19, wherein the at least one channel-projection comprises at least two spaced-apart elongate ledges formed on one of the channel-sidewalls, and at least two spaced-apart elongate ledges formed on the other of the channel-sidewalls, said ledges each extending lengthwise along the majority length of the channel-sidewall on which they are formed.

22. The fence system of claim 19, wherein the at least one plank-projection comprises a tab piece extending outwardly from an exterior surface of the fence plank at an acute angle relative to said exterior surface, said tab piece having an elastic memory connection to said exterior surface such that depression of said tab piece causes said tab piece to exert a reactive force against said depression.

23. The fence system of claim 19, wherein the planks are hollow and are comprised of sidewalls, said sidewalls having an opening formed in a free end section of the planks such that a circumferential edge defines said opening, and wherein the at least one plank-projection extends outwardly from a portion of said circumferential edge.

24. The fence system of claim 23, wherein the at least one plank-projection comprises a severed portion of the sidewalls of the plank.

25. The fence system of claim 19, wherein the fence planks are hollow, each plank having a front wall and an opposing rear wall, wherein the front and rear walls each include an elongate groove formed therein extending lengthwise along the plank.

26. The fence system of claim 19, wherein the fence planks each include a front wall and an opposing rear wall, and a plurality of internal bracing walls disposed between the front and rear walls in a transverse orientation with respect to said front and rear walls.

27. The fence system of claim 19, wherein the rail comprises an upper rail, the fence system further comprising:

a lower rail configured to be supported in a laterally extending orientation for holding the plurality of elongate fence planks upon it in an upwardly-extending position in cooperation with the upper rail, said lower rail having an elongate bottom side and an elongate top side, said lower rail further including an elongate open channel formed in the top side of said lower rail such that said elongate open channel includes an elongate channel-entrance that extends lengthwise along a majority length of the top side of said lower rail, the lower rail further including spaced apart channel-sidewalls extending inwardly from the elongate channel-entrance in the top side of the rail in a direction toward the bottom side of the rail to thereby define the elongate open channel therebetween, wherein the plurality of fence planks further include lower free ends configured and dimensioned to extend through the elongate channel-entrance of the open channel in the lower rail to reside slidably within said open channel to thereby enable the fence planks to be slidable toward and away from each other along said open channel when their lower free ends are positioned through the channel-entrance and into the open channel of the lower rail; and at least one lower channel-projection formed as part of at least one of the channel-sidewalls of the lower rail, said lower channel-projection extending outwardly from a surface of the channel-sidewall into engagement with the lower free ends of the fence planks when said fence planks are placed into the open channel in the lower rail, for increased support of the fence planks.

28. A fence system comprising:

a lower rail configured to be supported in a laterally extending orientation for holding a plurality of elongate fence planks upon it in an upwardly-extending position, said lower rail having an elongate bottom side and an elongate top side, said lower rail further including an elongate open channel formed in the top side of said lower rail such that said elongate open channel includes an elongate channel-entrance that extends lengthwise along a majority length of the top side of said lower rail, the lower rail further including spaced apart channel-sidewalls extending inwardly from the elongate channel-entrance in the top side of the rail in a direction toward the bottom side of the rail to thereby define the elongate open channel therebetween;

said plurality of fence planks having lower free ends configured and dimensioned to extend through the elongate channel-entrance of the open channel in the lower rail and reside slidably within said open channel to thereby enable the fence planks to be slidable toward and away from each other along the open channel when their free ends are positioned through the channel-entrance and into the open channel, and wherein each fence plank further comprises a front wall and a rear wall; and at least one channel-projection formed as part of at least one of the channel-sidewalls of the lower rail, said channel-projection extending outwardly from a surface of the channel-sidewall into engagement with the lower free ends of the fence planks when said fence planks are placed into the open channel of the lower rail, for increased support of the fence planks;

wherein the at least one channel-projection comprises at least one elongate ledge extending from one of the channel-sidewall surfaces, said ledge extending lengthwise along a majority length of said channel-sidewall such that the engagement of said ledge with the fence planks operates to prevent the front walls or rear walls of the fence planks disposed in engagement with said elongate ledge from contacting the surface of said channel-sidewall when said fence planks are placed through the elongate channel-entrance and into the open channel, such that the fence planks are slidable toward and away from each other along the open channel in engagement with said elongate ledge.

* * * * *